United States Patent [19]

Schmidt

[11] Patent Number: 4,612,794

[45] Date of Patent: Sep. 23, 1986

[54] MANUAL CRIMPING PLIERS

[75] Inventor: Dieter Schmidt, Rösrath, Fed. Rep. of Germany

[73] Assignee: HTS-Elektrotechnik GmbH, Neunkirchen, Fed. Rep. of Germany

[21] Appl. No.: 689,994

[22] Filed: Jan. 9, 1985

[30] Foreign Application Priority Data

Jan. 27, 1984 [DE] Fed. Rep. of Germany ... 8402284[U]

[51] Int. Cl.[4] ..... B21D 7/06

[52] U.S. Cl. ..... 72/410; 72/421; 29/751; 226/161

[58] Field of Search ..... 72/410, 409, 407, 421; 29/753, 751, 748; 81/57.37, 434, 435; 226/161–164, 158, 68; 83/423, 718

[56] References Cited

U.S. PATENT DOCUMENTS

| | | | |
|---|---|---|---|
| 3,070,144 | 12/1962 | Evans | 72/337 |
| 3,074,458 | 1/1963 | Evans | 72/407 |
| 3,184,950 | 5/1965 | Sitz | 29/753 |
| 3,230,758 | 1/1966 | Klinger | 72/410 |
| 3,611,782 | 10/1971 | Eddler | 72/410 |

*Primary Examiner*—Daniel C. Crane
*Attorney, Agent, or Firm*—Browdy and Neimark

[57] ABSTRACT

In crimping pliers for connecting contact elements to electrical conductors, which crimping pliers consist of a grip, a retaining plate, which is fixed to the latter and has a lateral recess accommodating the contact elements, on the upper side of which recess cutouts are made which interact with the crimping stamps which project at the upper side from a workplate displaceably guided in the retaining plate, on which workplate a hand lever is pivoted, the tightening movement of which displaces the workplate relative to the retaining plate and moves the crimping stamps into the open cutouts, a housing is fixed to the workplate in order to automatically feed a sheet-metal strip, which supports contact elements at intervals and has mating holes, and a linkage mechanism is pivoted on the hand lever. Moreover, a feed piece, which can be displaced along a longitudinal groove against the force of a feed spring and carries a lowerable dog for engaging in one of the mating holes, and a locking device, which retains the feed piece in the tensioned position of the feed spring and can be triggered by a linkage mechanism and a triggering unit, are provided in the housing. At the same time, the feed piece, during the tightening movement of the hand lever, is brought into its end position and locked in this position. During the return movement of the hand lever, the locking device and the feed piece are then released.

6 Claims, 6 Drawing Figures

Fig. 3
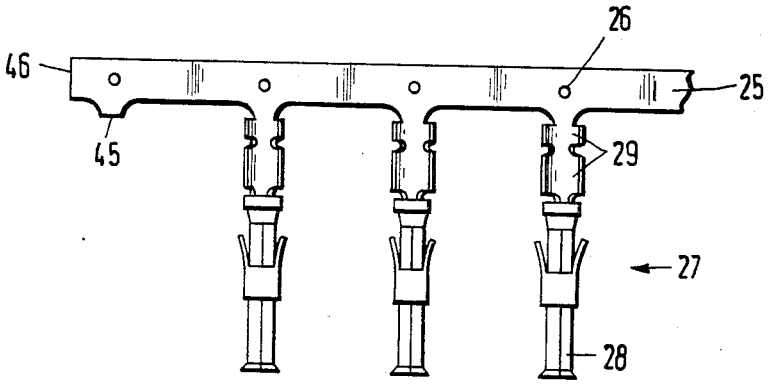
Fig. 4
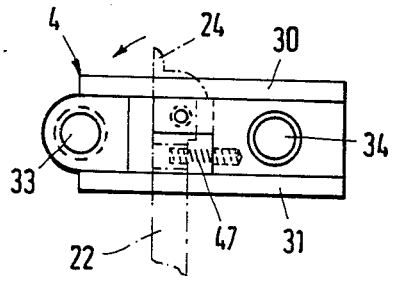
Fig. 5
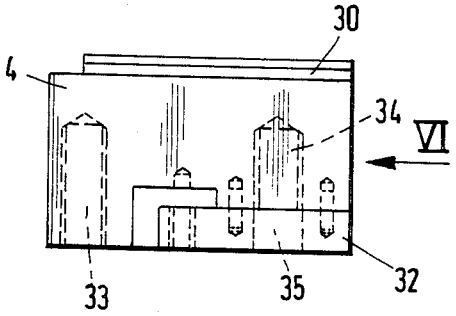
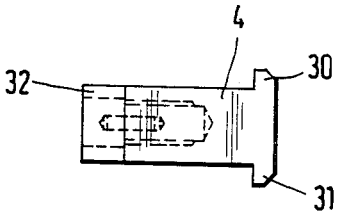
Fig. 6

MANUAL CRIMPING PLIERS

The invention relates to manual crimping pliers for connecting contact elements to electrical conductors, which manual crimping pliers consist of a grip, a retaining plate, which is fixed to the latter and has a lateral recess accommodating the contact elements, a stamping plate inserted at the upper side of the recess, which stamping plate has cutouts open towards the recess, and a workplate displaceably guided on this retaining plate, which workplate supports crimping stamps on its upper side and has a hand lever pivoted on it, which hand lever, at its other side, is connected to the retaining plate by a guide member, and with a support, which is aligned with the upper edge of the workplate, being provided for a sheet-metal strip which carries contact elements projecting at predetermined spacings from its side and which, at the same predetermined spacings, is provided with mating holes into which a dog can engage, which dog can be moved manually.

Manual crimping pliers of this type are used as manually operated tools in electrical engineering to connect contact elements to electrical conductors. This is effected by manually inserting the stripped end of an electrical conductor into the open end of a contact element. By the tightening movement of the hand lever against the grip, the lateral edges of the flat end of the contact element are rolled around the electrical conductor and fixed to the latter. The hand lever is returned into its initial position after the crimping operation, with the crimping stamp being moved out of the cutouts in the stamping plate and the contact element connected to the electrical conductor being released. Before a new crimping operation can be started, the sheet-metal strip supporting the contact elements has to be moved forward manually until the next contact element is aligned with the cutout and the crimping stamp of the pliers.

Because the manipulations are to be effected one after the other, a crimping operation using the known crimping pliers requires a considerable amount of working time. Therefore, relatively few contact elements can be connected to electrical conductors within a given time.

The object of the invention is to improve the known crimping pliers in such a way that the number of manipulations required to carry out a crimping operation can be reduced in such a way that tightening the handle of the crimping pliers against the grip and returning the hand lever from the grip are all that is necessary to connect contact elements to electrical conductors.

According to the invention, this object is achieved when a housing is fixed to the workplate, the upper edge of which housing forms a support for the sheet-metal strip, when a linkage mechanism is pivoted on the hand lever, when, moreover, a feed piece, which can be displaced along a longitudinal groove against the force of a feed spring and carries a lowerable dog for engaging in one of the mating holes in the sheet-metal strip, and a locking device, which retains the feed piece in the tensioned position of the feed spring or can be triggered by means of the linkage mechanism and a triggering unit, are provided in the housing, with the feed piece, during the tightening movement of the hand lever and when the dog is lowered, being brought against the grip into its rear end position remote from the recess and being engaged in this position, whereas the movement of the hand lever away from the grip opens the recess and releases the locking device by means of the triggering unit only at the last part of the throw and releases the feed piece together with the moved-out dog.

In these crimping pliers according to the invention, the sheet-metal strip supporting the contact elements is inserted along the upper edge of the housing until the frontmost contact element is aligned with the cutout in the stamping plate. The sheet-metal strip is held in this position by the dog engaged in one of the lockingholes. After a stripped end of an electrical conductor is placed on the flat end of the contact element, the hand lever is moved towards the grip, by which means the crimping stamp, together with the contact element, is moved into the cutout, and the edges of the flat area of the contact element are fixed on the electrical conductor by crimping. During this tightening movement of the hand lever, the feed piece is at the same time moved away from the recess against the force of the feed spring until it is engaged in its rear end position. During this movement of the hand lever, the dog has been moved out of the mating hole along the underside of the sheet-metal strip and into the next mating hole. If the hand lever has been moved into its end position against the grip, not only is the crimping operation complete, that is, connecting the contact element to the electrical conductor, but the electrical conductor has also been separated from the sheet-metal strip. Finally, at the same time as this movement, the crimping pliers are prepared for a new crimping operation insofar as the feed piece is prepared for the feed of the sheet-metal strip in such a way that the feed piece is released from the grip at the last part of the throw of the hand lever and moved towards the cutout by the force of the feed spring, with the sheet-metal strip being moved forward with the feed piece by the dog engaging in a locking hole. The crimping pliers are then ready for the next crimping operation. The electrical conductor need now only be placed manually onto the flat area of the contact element aligned with the cutout, and the hand lever moved against the grip.

Apart from a cutting device used for cutting off each crimped contact element from the sheet-metal strip, a cutting device which is subsequently arranged in the feed direction of the sheet-metal strip of the recess for cutting off the emerging sheet-metal strip can be provided, otherwise the complete length of the sheet-metal strip can emerge out of the crimping pliers and could hinder the operator.

To be able to adapt the movement path of the feed piece to the spacing of the contact elements, an adjustable stop, which determines the front end position of the feed piece, can be provided in the longitudinal groove in which the feed piece slides. In this way, the crimping pliers can be adapted to sheet-metal strips which support at various spacings the contact elements projecting from the sheet-metal strips.

The linkage mechanism controlled by the hand lever can consist of a guide member pivoted on the hand lever and a double-arm lever pivotably mounted in the housing, one end of which double-arm lever is pivoted on a guide member and the other end acts on the feed piece, by which means the latter, as a function of the movement of the hand lever, can move from its one end position into the other and can be locked in the latter.

To release the feed piece from the locking device at the last part of the throw of the hand lever and together with the moved-out dog, the end of the double-arm lever pivoted on the guide member carries a projection which acts on the triggering unit.

Details of the invention follow from the drawing, wherein:

FIG. 3 shows a plan view, to an enlarged scale, of a sheet-metal strip with contact elements projecting from it;

FIG. 4 shows a side view of the feed piece;

FIG. 5 shows a plan view of the feed piece shown in FIG. 4, and

FIG. 6 shows an end view of the feed device according to FIGS. 4 and 5 in the direction of the arrow VI.

Figure 1:
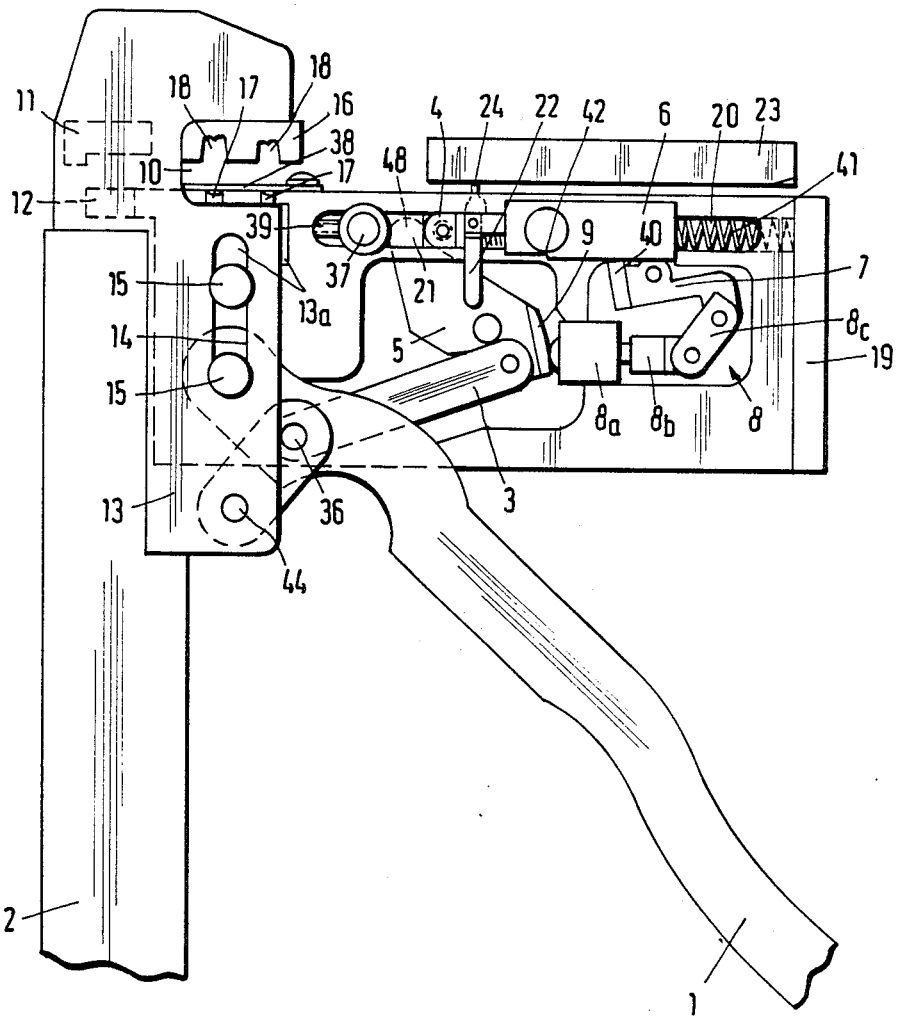
FIG. 1 shows a side view of the manual crimping pliers according to the invention, the hand lever of which is located in the position remote from the handle, with the cover plate of the housing being removed.
Figure 2:
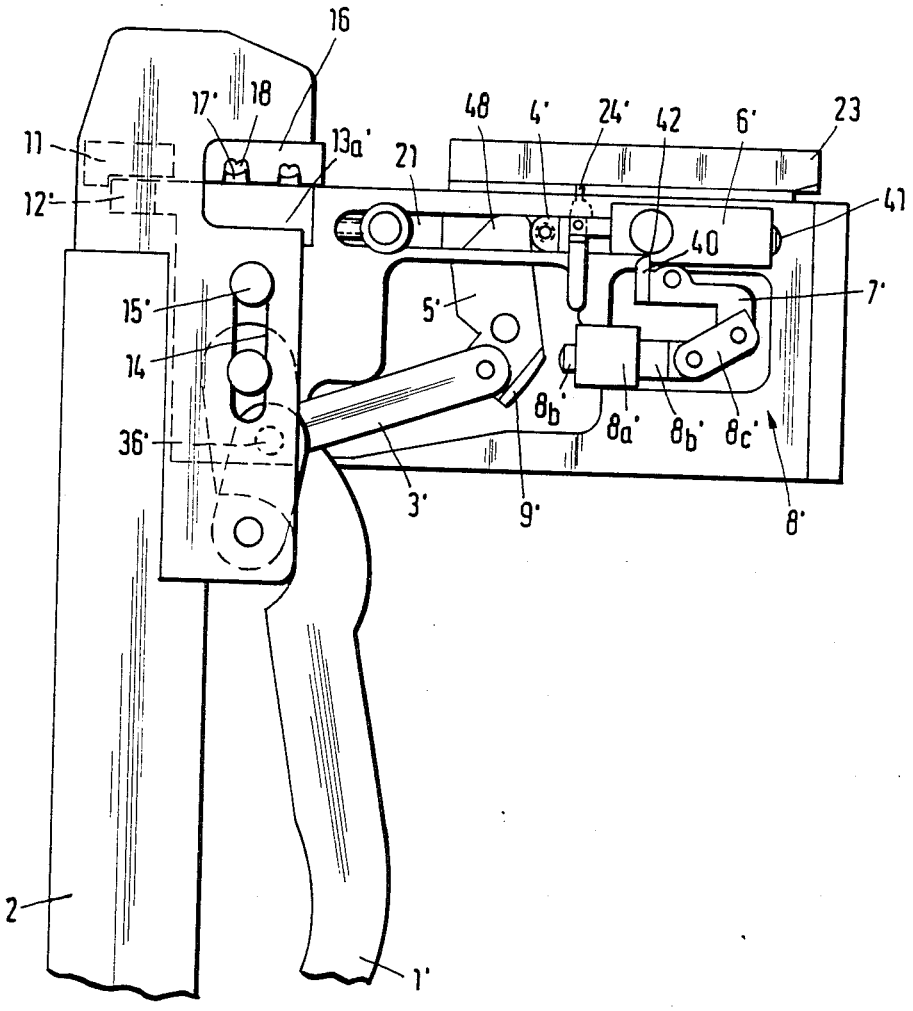
FIG. 2 shows a side view corresponding to FIG. 1, in which the hand lever is moved into its end position towards the handle.

The manual crimping pliers shown in FIG. 1 consist of a grip 2 which can be gripped manually or can be clamped in a device on a workbench. A retaining plate 13 is firmly connected to the grip and displaceably supports a workplate 13*a* in the longitudinal direction of the retaining plate 13. The workplate 13*a* has fixing elements 15 which extend through a slot 14 in the retaining plate 13 and limit the movement of the workplate 13*a* relative to the retaining plate 13. The fixing element 15 shown at the bottom of the drawing is at the same time used for pivoting the upper end of a hand lever 1 which is connected in an articulated manner to the retaining plate at 44 via a pivot pin 36 and by a guide member 43.

The retaining plate 13 has a lateral recess 10 at a distance from the slot 14, which recess 10 is used for accommodating the contact elements. A stamping plate 16 is fixed on the upper side of the recess 10, which stamping plate 16 is provided with cutouts 18 which are open towards the recess 10. Opposite these cutouts, the workplate 13*a* supports crimping stamps 17 which can be moved together with the workplate towards the cutouts 18.

The workplate 13*a*, at its rear side, is connected to a housing 19, so that the latter, together with the workplate, can move relative to the retaining plate 13. The upper edge of the housing 19 forms a support for a sheet-metal strip 25 (FIG. 3), with contact elements 27 projecting from the latter at intervals. In the illustrative embodiment shown in the drawing, these contact elements 27 consist of a sleeve part 28 and two crimping parts 29 which are bent slightly forward.

The housing 19 has a longitudinal groove 20 running parallel to the support, which longitudinal groove 20 is used for guiding a feed piece 4. The feed piece 4 supports a dog 24 which can be swivelled against the force of a return spring in the direction of the arrdw shown in FIG. 4. A handle 22 is carried on the dog 24 in order to swivel the latter manually. For guidance in the longitudinal groove 20, the feed piece is provided with lateral flanges 30 and 31 which slide along the housing surface which is remote in the drawing. The feed piece 4 is secured against falling out of the longitudinal groove by screws which can be inserted into the threaded holes 33 and 34. Moreover, the screw inserted into the threaded hole 34 fixes at the same time a locking plate 6 which has a notch 42 beneath the screw. A cutout is provided in the feed piece 4 for supporting and mounting the dog 24, which cutout is covered by a support plate 32. The screw retaining the support plate extends through a non-threaded hole 35 in the support plate and into the threaded hole 34.

A feed spring 41 acts on the right-hand end, as viewed in FIG. 1 of the drawing, of the feed piece 4 to move the feed piece 4 in feed direction A. This feed spring 41 is supported at one end against the feed piece, whereas the other end extends into a guide hole in the housing 19. The opposite end of the feed piece 4 sits against a stop 21 which can be adjusted by a screw 39 and fixed by a screw 37.

A linkage mechanism is allocated to the housing 19, which linkage mechanism consists of a double-arm lever 5 pivotably mounted in the housing. One end of this pivotable lever 5 is connected in an articulated manner by means of a guide member 3 to the pivot pin 36 of the hand lever 1. The other end 48 of the double-arm lever 5 acts on the feed piece end adjacent to the stop 21 in such a way that, during the tightening movement of the hand lever against the grip, the end 48 of the double-arm lever 5 moves the feed piece 4 in the longitudinal groove 20 towards the right in the drawing, with the feed spring 41 being tensioned.

Moreover, a triggering unit is arranged in the housing. This consists of a catch 7, on one end of which is arranged a locking catch 40 which interacts with the notch 42 if the feed piece 4 is located in its right-hand end position. The other end of the catch 7, which is designed as a double-arm lever, is connected by a guide member 8*c* to a pin 8*b* which is mounted in a guide 8*a* in such a way that its free end projects from the guide 8*a*.

A projection 9, which is supported by the double-arm lever 5, on the end on which the guide member 3 is pivoted, interacts with the pin 8*b* of the triggering unit. If the hand lever 1 is moved away from the grip, the projection 9 strikes the free end of the pin 8*b* of the triggering unit and moves the pin 8*b* towards the right in the drawing. The catch 7 is swivelled by the guide member 8*c* in such a way that the locking catch 40 is moved out of the notch 42. Consequently, the feed piece is released and can be moved in the longitudinal groove 20 by the feed spring 41 to the left towards the stop 21. Moreover, the moved-out dog 24, which is located in a locking hole 26 of the sheet-metal strip 25, moves the sheet-metal strip towards the left in the drawing. At the same time, the rail arranged at a distance from the upper edge of the housing 19 is used as a guide.

During the last part of the tightening movement of the hand lever 1 against the grip 2, the contact element 27, which is already connected to an electrical conductor, is separated from the sheet-metal strip 25 along the cut edge 45 by a cutting edge 38. At the same time, the front end of the sheet-metal strip 25 is separated along the cut edge 46 by cutting blades 11 and 12. The cutting blade 11 is supported by the retaining plate 13, whereas the cutting blade 12 fixed to the housing 19 moves together with the latter relative to the cutting blade 11. In this way, after the feed movement of the feed piece 4, only one piece of the sheet-metal strip 25 projects beyond the left-hand edge (as viewed in the drawing) of the retaining plate 13, the length of which is only a fraction of the distance between the contact elements. Thus the sheet-metal strip 25 emerging from the crimping pliers cannot hinder the operator of the crimping pliers.

I claim:

1. Manual crimping pliers for connecting contact elements to electrical conductors, the contact elements being supported on a carrier strip having holes located between adjacent contact elements, the manual crimping pliers including:

a grip, a retaining plate firmly connected to the grip and including a lateral recess for accommodating the contact elements, a stamping plate supported at an upper side of the recess, said stamping plate having cutouts open towards the recess, a workplate displaceably guided on said retaining plate, said workplate having an upper side supporting crimping stamps, a hand lever disposed opposite said grip and having one end pivotably connected to the retaining plate and to a support for said carrier strip, said pliers further comprising:

a housing fixed to the workplate and including an upper edge, a groove disposed substantially parallel to said upper edge, and a feed spring disposed in the groove, the upper edge of said housing defining said support for said carrier strip, linkage means pivotably connected between said hand lever and said housing, a feed piece, displaceably supported in said housing groove for displacement at least toward said recess in a feeding direction, and carrying a dog for engaging in one of the holes in the carrier strip, locking means, mounted in said housing, for releasably retaining said feed piece in a first position in which said feed spring is tensioned, and triggering means for releasing said locking means, and thereby said feed piece from said first position, said triggering means being actuated by said linkage means, whereby upon pivoting movement of said hand lever away from said grip, simultaneously said feed piece, said dog and said carrier strip are biased away from said first position toward said recess so that crimping of said contacts on said conductors can be effected, and thereafter when said hand lever is pivoted toward the grip, said locking means is actuated as said feed piece is moved back to its first position in said longitudinal groove.

2. The manual crimping pliers as claimed in claim 1, and further comprising a cutting device, provided in said recess, for cutting off each contact element from said carrier strip after the contact element has been crimped on a respective conductor.

3. The manual crimping pliers as claimed in claim 2, and further comprising cutting means, located in the feed direction of said carrier strip beyond the recess, for cutting off the emerging carrier strip.

4. The manual crimping pliers as claimed in claim 1, and further comprising an adjustable stop which is located in the longitudinal groove and which determines the front end position of the feed piece.

5. The manual crimping pliers as claimed in claim 1, wherein the linkage means consists of a guide member pivotably coupled with the hand lever, and a double-arm lever pivotably mounted in the housing, one arm of said double-arm lever being pivoted on the guide member, and the other arm of said double arm lever acting on the feed piece.

6. The manual crimping pliers as claimed in claim 5, wherein said one arm carries a projection which actuates said triggering means.

* * * * *